US006367160B1

(12) United States Patent
Rempe

(10) Patent No.: US 6,367,160 B1
(45) Date of Patent: Apr. 9, 2002

(54) SIDING GAUGE TOOL

(76) Inventor: Steve Rempe, P.O. Box 1980, Novato, CA (US) 94948

( * ) Notice: Subject to any disclaimer, the term of this patent is extended or adjusted under 35 U.S.C. 154(b) by 0 days.

(21) Appl. No.: 09/507,472

(22) Filed: Feb. 17, 2000

(51) Int. Cl.[7] ..... G01B 3/30
(52) U.S. Cl. ..... 33/647; 33/648
(58) Field of Search ..... 33/646, 647, 648, 33/649, 411; 52/547, 548, 408, 105, 99

(56) References Cited

U.S. PATENT DOCUMENTS

| | | | | |
|---|---|---|---|---|
| 1,510,497 A | * | 10/1924 | Keller | 52/547 |
| 1,537,952 A | * | 5/1925 | Kridler et al. | 52/548 |
| 4,159,029 A | | 6/1979 | Matthews | |
| 4,164,346 A | | 8/1979 | Sickler | |
| 4,314,429 A | | 2/1982 | Casteel et al. | |
| 4,425,714 A | | 1/1984 | Kelly, Jr. | |
| 4,936,021 A | * | 6/1990 | Frenette et al. | 33/649 |
| 5,400,519 A | | 3/1995 | Meyer | |
| 5,522,149 A | | 6/1996 | Meyer | |

* cited by examiner

*Primary Examiner*—Andrew H. Hirshfeld
(74) *Attorney, Agent, or Firm*—Plunkett & Cooney, PC; Arnold S. Weintraub

(57) ABSTRACT

A tool for installation of building siding includes an elongate base portion, an arm portion extending at a right angle thereto, and terminates in a flange portion extending at a right angle from the arm. A clip member is carried on the upper surface of the base, and extends toward the arm portion to define a gap therebetween. For use, one or more of the tools are placed on the bottom edge of the piece of siding so that the siding is releasably captured in the gap. The piece of siding can then be placed at an appropriate position on a wall above a previously-installed piece of siding, so that the flange rests on the upper edge of the previously installed piece. The installer may rest the piece of new siding, with the tool(s) in place, on the previously installed piece of siding, enabling the installer to temporarily nail the new piece in place. The tool(s) can then be removed from the new piece by twisting and pulling down on the handle portion.

2 Claims, 1 Drawing Sheet

SIDING GAUGE TOOL

BACKGROUND OF THE INVENTION

1. Field of the Invention

This invention relates generally to construction tools and hardware, and more specifically to an improved tool for the installation of siding material such as fiber cement siding to a building structure.

2. Description of the Prior Art

Building siding is well known and in widespread use. Siding material typically is manufactured in elongate boards which must be secured to a building in overlapping fashion. Installation of these boards can be awkward and time consuming, often requiring two or more people. Numerous tools have been designed to assist in siding installation. However, none of the known prior art devices enable simple and efficient installation of a length of siding by one person.

SUMMARY OF THE INVENTION

The siding gauge tool of this invention provides a device that, when placed on a piece of siding before installation, automatically gauges the overlap of the siding, eliminating the task of measuring and marking by the installer. In addition, the tool keeps the siding from slipping during the initial nailing. Finally, the tool allows one person to hang, gauge, hold and nail the siding.

The inventive tool includes an elongate base or handle portion, an arm portion extending generally at a right angle thereto, and terminates in a flange portion extending generally at a right angle from the arm. A spring or clip member is carried on the upper surface of the base, and extends toward the arm portion, preferably to define a gap therebetween. For use, one or more (and preferably two) of the tools are placed on the bottom edge of the piece of siding so that the siding is releasably captured in the gap between the clip and arm, and is held there by the spring tension, with the bottom edge of the siding resting on the upper surface of the base. The piece of siding can then be placed at an appropriate position on a wall above a previously-installed piece of siding, so that the flange of the tool rests on the upper edge of the previously installed piece, and the length of the arm portion thus defines the desired overlap of the siding pieces (e.g., one and one-quarter inches). The installer may rest the piece of new siding, with the tool(s) in place, on the previously installed piece of siding, enabling the installer to temporarily nail the new piece in place. The tool(s) can then be removed from the new piece by twisting and pulling down on the handle portion to both disengage the flange from the previous piece, and release the new piece from the spring tension between the clip and arm. The new piece of siding, with the tool(s) now removed, can now be completely nailed in place, and the process repeated with subsequent runs of siding.

The siding gauge tool of this invention thus gauges the lap distance for siding installation. When used as a pair (one tool on each side of the siding piece), the device enables installation of a length of siding by one person. The device is attached to the free piece of siding, and facilitates the installation of siding with little effort. The device is simple to use and efficient, unlike other known siding tools.

The spring attachment allows flexibility when installing. The "flange" used for gauging allows for accurate gauging but far less resistance when removing from the installed siding. This "flange" will not cut or scar the siding or paper.

BRIEF DESCRIPTION OF THE DRAWINGS

FIG. 2 is an end elevation cross-sectional view of a first piece (course) of siding and starter strip as nailed to a wall;

FIG. 3 is an end elevation view of the inventive tool as placed on the lower edge of a second piece of siding;

FIG. 4 is a perspective view of the second piece of siding bearing two of the inventive tools being positioned on the wall above the first piece of siding;

FIG. 5 is a perspective view of the second piece of siding in position on the wall above the first piece of siding with the second piece of siding attached to the wall only at the top edge and the pair of tools still in place; and FIG. 6 is an end elevational cross-sectional view of the second piece of siding attached to the wall prior to the removal of the inventive tools.

DETAILED DESCRIPTION OF A PREFERRED EMBODIMENT

Figure 1:
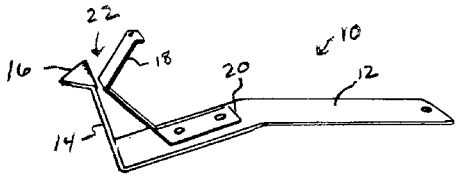
FIG. 1 is a perspective view of the siding gauge tool of this invention.

FIG. 1 is a perspective view of the siding gauge tool 10 of this invention. Tool 10 includes an elongate base or handle portion 12, and arm portion 14 extending upwardly preferably at a right angle to the handle portion, and a flange portion 16 extending preferably at a right angle outwardly from the arm portion. Spring or clip member 18 is carried on the upper surface 20 of the base, and extends toward the arm portion 14, preferably to define a gap 22 therebetween (alternatively, the clip member may actually contact the arm). The point of closest extent (or contact) of the clip member to the arm is preferably at least some distance less than the length of the arm portion. It is the length of the arm portion 14 that defines the overlap between each piece of siding when installed. The length of the flange portion 16 is preferably less than the thickness of the siding being installed.

Figure 2:
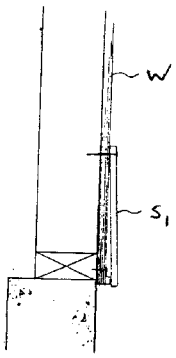
FIGS. 2–6 are a series of views illustrating the use of the inventive tool to install siding to a structure.

FIGS. 2–6 are a series of views illustrating the use of the inventive tool 10 to install siding to a structure. FIG. 2 is an end elevation cross-sectional view of a first piece (course) of siding $S_1$ and starter strip as nailed to a wall W.

Figure 3:
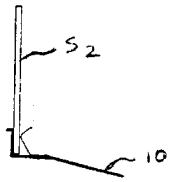
Figure 4:
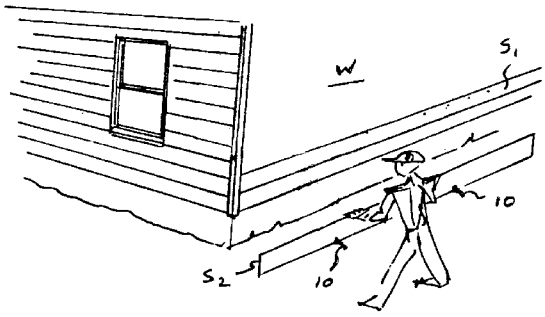
Figure 5:
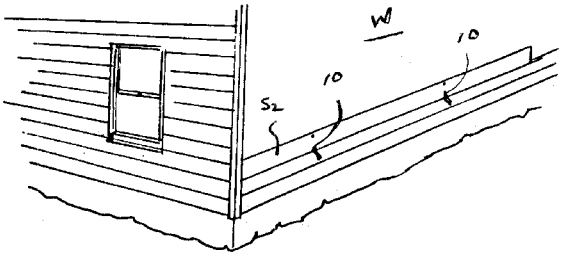
Figure 6:
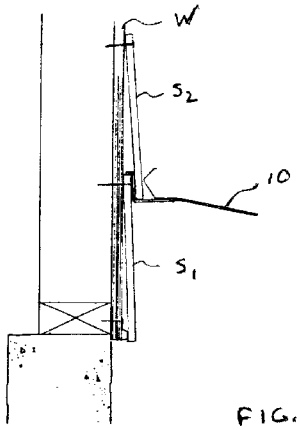

FIG. 3 is an end elevation view of the inventive tool 10 as placed on the lower edge of a second piece of siding $S_2$. FIG. 4 is a perspective view of the second piece of siding $S_2$ bearing two of the inventive tools 10 being positioned on the wall W above the first piece of siding $S_1$. FIG. 5 is a perspective view of the second piece of siding $S_2$ in position on the wall above the first piece of siding $S_1$ with the second piece of siding $S_2$ attached to the wall W only at the top edge and the pair of tools 10 still in place. FIG. 6 is an end elevational cross-sectional view of the second piece of siding $S_2$ attached to the wall W prior to the removal of the inventive tools 10.

Instructions for use of the siding gauge tool of this invention may include the following:

First, hang a starter strip and the first course of siding. Cut the next piece of siding to length. Push the siding gauge tool over the bottom edge of the next piece of siding, locating each gauge approximately three feet of the center of the board. Use the siding gauge tools to hang the next piece of siding on the previous course (note that it automatically engages the overlap of each piece of siding while keeping it from slipping during initial nailing). Tack the siding only at the top edge, per the manufacturers specifications and in the vicinity of the siding gauge tools. Do not nail the siding completely prior to removal of the siding gauge tools or removal of the tools will be more difficult. Remove the siding gauge tools by gently twisting and pulling down. Complete the nailing of the siding per the manufacturers specifications. Repeat the above steps for all subsequent courses of siding.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A removable tool for installing elongated building siding to a wall, said siding having top and bottom edge portions and a predetermined thickness, said tool comprising:

(a) an elongate base portion having first and second end portions and an upper surface for supporting the bottom edge portion of a piece of siding to be installed;

(b) an arm portion connected to and extending generally at a right angle from the first end portion of said base portion, said arm portion terminating in a flange portion for resting on the top edge of a previously installed piece of siding, said flange portion extending generally at a right angle from said arm portion and In a direction away from the second end portion of said base portion;

(c) a resilient dip member carried on the second and portion of said base portion, said clip member extending toward said arm portion and terminating in a deflectable free end; and (d) a handle for positioning the base portion against the bottom edge portion of said siding to be installed, said handle being spaced from the deflectable free end of said clip member;

wherein one or more of said tools may be placed on the bottom edge of a first piece of siding so that the first piece of siding is releasably captured between said clip member and said arm portion, and the piece of siding can then be placed at an appropriate position on a wall above a previously-installed piece of siding, so that said flange portion removably rests on the top edge of the previously installed piece.

2. The tool of claim 1 wherein said arm portion has a length such that when said flange portion of the tool used to install said first piece of siding rests on the top edge of the previously installed piece, the arm portion and base of the tool positioning the bottom edge of the siding being installed so as to overlap the top edge of a previously installed piece of siding.

* * * * *